US007523937B2

(12) United States Patent
Fleckenstein

(10) Patent No.: US 7,523,937 B2
(45) Date of Patent: Apr. 28, 2009

(54) DEVICE FOR USE IN PLAYING CARD HANDLING SYSTEM

(75) Inventor: Allen Fleckenstein, Bellevue, WA (US)

(73) Assignee: Bally Gaming, Inc., Las Vegas, NV (US)

( * ) Notice: Subject to any disclaimer, the term of this patent is extended or adjusted under 35 U.S.C. 154(b) by 523 days.

(21) Appl. No.: 11/428,253

(22) Filed: Jun. 30, 2006

(65) Prior Publication Data

US 2007/0241496 A1 Oct. 18, 2007

Related U.S. Application Data

(60) Provisional application No. 60/793,267, filed on Apr. 18, 2006.

(51) Int. Cl.
*A63F 1/12* (2006.01)

(52) U.S. Cl. ..... 273/149 R; 273/149 P

(58) Field of Classification Search ..... 273/149 R, 273/149 P; 463/22

See application file for complete search history.

(56) References Cited

U.S. PATENT DOCUMENTS

| | | | | |
|---|---|---|---|---|
| 1,034,402 | A | 7/1912 | Hardy | |
| 1,727,800 | A | 9/1929 | Albert | |
| 1,890,504 | A | 12/1932 | Ferguson, Jr. | |
| 2,567,223 | A | 9/1951 | Maher | |
| 2,663,418 | A | 12/1953 | Grunwald | 206/62 |
| 2,694,662 | A | 11/1954 | Hunter, Jr. | 154/121 |
| 2,731,271 | A | 1/1956 | Brown | |
| 3,222,071 | A | 12/1965 | Lang | 273/149 |
| 3,312,473 | A | 4/1967 | Friedman et al. | 273/149 |
| 3,377,070 | A | 4/1968 | Nottoli | 273/149 |
| 3,493,728 | A | 2/1970 | Braden, Jr. et al. | |
| 3,561,756 | A | 2/1971 | Barnett | 271/41 |
| 3,667,759 | A | 6/1972 | Barr | 273/152.1 |
| 3,690,670 | A | 9/1972 | Cassady et al. | 273/149 P |
| 3,751,041 | A | 8/1973 | Seifert | 273/149 P |
| 3,752,962 | A | 8/1973 | Greskovics | 235/61.11 |
| 3,814,436 | A | 6/1974 | Boren | 273/149 P |
| 3,897,954 | A | 8/1975 | Erickson et al. | 273/149 R |
| 3,929,339 | A | 12/1975 | Mattioli | 273/148 A |
| 4,031,376 | A | 6/1977 | Corkin, Jr. | 235/156 |
| 4,135,663 | A | 1/1979 | Nojiri et al. | 235/463 |
| 4,241,921 | A | 12/1980 | Miller | 273/148 A |
| 4,244,582 | A | 1/1981 | Raees et al. | 273/293 |

(Continued)

FOREIGN PATENT DOCUMENTS

DE 44 39 502 C1 9/1995

(Continued)

OTHER PUBLICATIONS

U.S. Appl. No. 11/558,409, filed Nov. 9, 2006, Soltys.

(Continued)

*Primary Examiner*—Benjamin H Layno
(74) *Attorney, Agent, or Firm*—Frank Abramonte; Marvin A. Hein

(57) ABSTRACT

A playing card handling system includes a pivoting pair of jaws to retrieve playing cards from a playing card receiver, for example a carousel. The rotational or angular velocity of a picker may be approximately equal to a rotational or angular velocity of a pickup roller, as the picker approaches the pickup roller.

26 Claims, 7 Drawing Sheets

U.S. PATENT DOCUMENTS

| | | | | |
|---|---|---|---|---|
| 4,310,160 | A | 1/1982 | Willette et al. | 273/149 R |
| 4,373,726 | A | 2/1983 | Churchill et al. | 273/138 A |
| 4,377,285 | A | 3/1983 | Kadlic | 273/148 A |
| 4,448,419 | A | 5/1984 | Telnaes | 273/143 R |
| 4,457,512 | A | 7/1984 | Stevenson | 273/148 |
| 4,497,488 | A | 2/1985 | Plevyak et al. | 273/149 R |
| 4,512,580 | A * | 4/1985 | Matviak | 273/148 A |
| 4,513,969 | A * | 4/1985 | Samsel, Jr. | 273/149 R |
| 4,531,187 | A | 7/1985 | Uhland | 364/412 |
| 4,531,909 | A | 7/1985 | Takeshita | 432/37 |
| 4,534,562 | A | 8/1985 | Cuff et al. | 273/149 P |
| 4,586,712 | A | 5/1986 | Lorber et al. | 273/149 R |
| 4,636,846 | A | 1/1987 | Villarreal | 358/100 |
| 4,659,082 | A | 4/1987 | Greenberg | 273/149 R |
| 4,662,637 | A | 5/1987 | Pfeiffer | 273/149 P |
| 4,667,959 | A | 5/1987 | Pfeiffer et al. | 273/149 R |
| 4,693,480 | A | 9/1987 | Smith | 273/296 |
| 4,725,079 | A | 2/1988 | Koza et al. | 283/73 |
| 4,728,108 | A | 3/1988 | Neuwahl | 273/296 |
| 4,750,743 | A | 6/1988 | Nicoletti | 273/148 A |
| 4,770,421 | A | 9/1988 | Hoffman | 273/149 R |
| 4,807,884 | A | 2/1989 | Breeding | 273/149 R |
| 4,817,528 | A | 4/1989 | Baker | 101/395 |
| 4,822,050 | A | 4/1989 | Normand et al. | 273/149 P |
| 4,832,341 | A | 5/1989 | Muller et al. | 273/139 |
| 4,832,342 | A | 5/1989 | Plevyak et al. | 273/149 R |
| 4,885,700 | A | 12/1989 | Kondziolka et al. | 364/519 |
| 4,951,950 | A | 8/1990 | Normand et al. | 273/149 P |
| 4,969,648 | A | 11/1990 | Hollinger et al. | 273/149 R |
| 4,995,615 | A | 2/1991 | Cheng | 273/292 |
| 4,998,737 | A | 3/1991 | Lamle | 273/296 |
| 5,000,453 | A | 3/1991 | Stevens et al. | 273/149 R |
| 5,039,102 | A | 8/1991 | Miller | 273/148 R |
| 5,053,612 | A | 10/1991 | Pielemeier et al. | 235/462 |
| 5,067,713 | A | 11/1991 | Soules et al. | 273/149 P |
| 5,096,197 | A | 3/1992 | Embury | 273/149 R |
| 5,110,134 | A | 5/1992 | Laughlin et al. | 273/293 |
| 5,114,153 | A | 5/1992 | Rosenwinkel et al. | 273/292 |
| 5,121,921 | A | 6/1992 | Friedman et al. | 273/149 P |
| 5,157,602 | A | 10/1992 | Fields et al. | 364/412 |
| 5,186,464 | A | 2/1993 | Lamle | 273/149 R |
| 5,199,710 | A | 4/1993 | Lamle | 273/149 R |
| 5,216,234 | A | 6/1993 | Bell | 235/494 |
| 5,224,712 | A | 7/1993 | Laughlin et al. | 273/304 |
| 5,240,140 | A | 8/1993 | Huen | 221/13 |
| 5,259,907 | A | 11/1993 | Soules et al. | 156/277 |
| 5,261,667 | A | 11/1993 | Breeding | 273/149 R |
| 5,275,411 | A | 1/1994 | Breeding | 273/149 R |
| 5,283,422 | A | 2/1994 | Storch et al. | 235/375 |
| 5,303,921 | A | 4/1994 | Breeding | 273/149 R |
| 5,312,104 | A | 5/1994 | Miller | 273/148 R |
| 5,319,181 | A | 6/1994 | Shellhammer et al. | 235/462 |
| 5,343,028 | A | 8/1994 | Figarella et al. | 235/462 |
| 5,344,146 | A | 9/1994 | Lee | 273/149 R |
| 5,356,145 | A | 10/1994 | Verschoor | 273/149 R |
| 5,362,053 | A | 11/1994 | Miller | 273/148 R |
| 5,374,061 | A | 12/1994 | Albrecht | 273/149 R |
| 5,382,024 | A | 1/1995 | Blaha | 273/149 R |
| 5,397,133 | A | 3/1995 | Penzias | 273/439 |
| 5,416,308 | A | 5/1995 | Hood et al. | 235/454 |
| 5,417,431 | A | 5/1995 | Gluck | 273/293 |
| 5,431,399 | A | 7/1995 | Kelley | 273/149 P |
| 5,445,377 | A | 8/1995 | Steinbach | 273/149 R |
| 5,511,784 | A | 4/1996 | Furry et al. | 273/143 R |
| 5,518,249 | A | 5/1996 | Sines et al. | 273/304 |
| 5,548,110 | A | 8/1996 | Storch et al. | 235/472 |
| 5,575,475 | A | 11/1996 | Steinbach | 273/149 R |
| 5,584,483 | A | 12/1996 | Sines et al. | 273/149 R |
| 5,605,334 | A | 2/1997 | McCrea, Jr. | 273/309 |
| 5,613,680 | A | 3/1997 | Groves et al. | 273/138.2 |
| 5,632,483 | A | 5/1997 | Garczynski et al. | 273/148 R |
| 5,654,050 | A | 8/1997 | Whalen-Shaw | 428/35.7 |
| 5,655,961 | A | 8/1997 | Acres et al. | 463/27 |
| 5,669,816 | A | 9/1997 | Garczynski et al. | 463/12 |
| 5,676,372 | A | 10/1997 | Sines et al. | 273/149 R |
| 5,681,039 | A | 10/1997 | Miller | 273/148 R |
| 5,683,085 | A | 11/1997 | Johnson et al. | 273/149 R |
| 5,685,543 | A | 11/1997 | Garner | 273/148 A |
| 5,692,748 | A | 12/1997 | Frisco et al. | 273/149 R |
| 5,695,189 | A | 12/1997 | Breeding et al. | 273/149 R |
| 5,698,839 | A | 12/1997 | Jagielinski et al. | 235/493 |
| 5,707,287 | A | 1/1998 | McCrea, Jr. | 463/27 |
| 5,711,525 | A | 1/1998 | Breeding | 273/292 |
| 5,718,427 | A | 2/1998 | Cranford et al. | 273/149 R |
| 5,722,893 | A | 3/1998 | Hill et al. | 463/47 |
| 5,735,525 | A | 4/1998 | McCrea, Jr. | 273/309 |
| 5,766,074 | A | 6/1998 | Cannon et al. | 463/16 |
| 5,770,533 | A | 6/1998 | Franchi | 463/42 |
| 5,772,505 | A | 6/1998 | Garczynski et al. | 463/12 |
| 5,779,545 | A | 7/1998 | Berg et al. | 463/22 |
| 5,779,546 | A | 7/1998 | Meissner et al. | 463/25 |
| 5,780,831 | A | 7/1998 | Seo et al. | 235/462 |
| 5,788,573 | A | 8/1998 | Baerlocher et al. | 463/16 |
| 5,791,988 | A | 8/1998 | Nomi | 463/11 |
| 5,803,808 | A | 9/1998 | Strisower | 463/11 |
| 5,803,809 | A | 9/1998 | Yoseloff | 463/13 |
| 5,830,064 | A | 11/1998 | Bradish et al. | 463/22 |
| 5,831,669 | A | 11/1998 | Adrain | 348/143 |
| 5,842,921 | A | 12/1998 | Mindes et al. | 463/16 |
| 5,863,249 | A | 1/1999 | Inoue | 463/20 |
| 5,871,400 | A | 2/1999 | Yfantis | 463/22 |
| 5,895,048 | A | 4/1999 | Smith, Jr. | 273/293 |
| 5,911,626 | A | 6/1999 | McCrea, Jr. | 463/27 |
| 5,919,091 | A | 7/1999 | Bell et al. | 463/25 |
| 5,941,769 | A | 8/1999 | Order | 463/12 |
| 5,944,310 | A | 8/1999 | Johnson et al. | 273/149 R |
| 5,945,654 | A | 8/1999 | Huang | 235/449 |
| 5,949,050 | A | 9/1999 | Fosbenner et al. | 235/449 |
| 5,954,654 | A | 9/1999 | Eaton et al. | 600/462 |
| 5,967,893 | A | 10/1999 | Lawrence et al. | 463/10 |
| 5,989,122 | A | 11/1999 | Roblejo | 463/22 |
| 6,010,404 | A | 1/2000 | Walker et al. | 463/21 |
| 6,019,368 | A | 2/2000 | Sines et al. | 273/149 R |
| 6,039,650 | A | 3/2000 | Hill | 463/47 |
| 6,042,150 | A | 3/2000 | Daley | 283/86 |
| 6,062,481 | A | 5/2000 | Storch et al. | 235/494 |
| 6,062,981 | A | 5/2000 | Luciano, Jr. | 463/26 |
| 6,068,258 | A | 5/2000 | Breeding et al. | 273/149 R |
| 6,068,552 | A | 5/2000 | Walker et al. | 463/21 |
| 6,093,103 | A | 7/2000 | McCrea, Jr. | 463/27 |
| 6,117,009 | A | 9/2000 | Yoseloff | 463/20 |
| 6,117,012 | A | 9/2000 | McCrea, Jr. | 463/27 |
| 6,126,166 | A | 10/2000 | Lorson et al. | 273/148 R |
| 6,139,014 | A | 10/2000 | Breeding et al. | 273/149 R |
| 6,145,838 | A | 11/2000 | White | 273/295 |
| 6,149,154 | A | 11/2000 | Grauzer et al. | 273/149 R |
| 6,152,822 | A | 11/2000 | Herbert | 463/22 |
| 6,159,096 | A | 12/2000 | Yoseloff | 463/20 |
| 6,166,763 | A | 12/2000 | Rhodes et al. | 348/143 |
| 6,186,892 | B1 | 2/2001 | Frank et al. | 463/19 |
| 6,193,607 | B1 | 2/2001 | Kay | 463/22 |
| 6,196,547 | B1 | 3/2001 | Pascal et al. | 273/292 |
| 6,217,447 | B1 | 4/2001 | Lofink et al. | 463/12 |
| 6,234,898 | B1 | 5/2001 | Belamant et al. | 463/25 |
| 6,250,632 | B1 | 6/2001 | Albrecht | 273/149 R |
| 6,254,096 | B1 | 7/2001 | Grauzer et al. | 273/149 R |
| 6,254,484 | B1 | 7/2001 | McCrea, Jr. | 463/27 |
| 6,267,248 | B1 | 7/2001 | Johnson et al. | 209/547 |
| 6,267,671 | B1 | 7/2001 | Hogan | 463/25 |
| 6,293,546 | B1 | 9/2001 | Hessing et al. | 273/138.2 |
| 6,293,864 | B1 | 9/2001 | Romero | 463/12 |
| 6,299,167 | B1 | 10/2001 | Sines et al. | 273/149 R |
| 6,299,170 | B1 | 10/2001 | Yoseloff | 273/292 |
| 6,299,536 | B1 | 10/2001 | Hill | 463/47 |

| | | | | |
|---|---|---|---|---|
| 6,312,334 | B1 | 11/2001 | Yoseloff | 463/25 |
| 6,313,871 | B1 | 11/2001 | Schubert | 348/143 |
| 6,315,664 | B1 | 11/2001 | Baerlocher et al. | 463/21 |
| 6,325,373 | B1 | 12/2001 | Breeding et al. | 273/149 R |
| 6,346,044 | B1 | 2/2002 | McCrea, Jr. | 463/27 |
| 6,357,746 | B1 | 3/2002 | Sadowski | 273/148 R |
| 6,361,044 | B1 | 3/2002 | Block et al. | 273/149 R |
| 6,371,482 | B1 | 4/2002 | Hall, Jr. | 273/138.1 |
| 6,386,973 | B1 | 5/2002 | Yoseloff | 463/13 |
| 6,394,902 | B1 | 5/2002 | Glavich | 463/20 |
| 6,402,142 | B1 | 6/2002 | Warren et al. | 273/149 R |
| 6,403,908 | B2 | 6/2002 | Stardust et al. | 209/587 |
| 6,406,023 | B1 | 6/2002 | Rowe | 273/292 |
| 6,406,369 | B1 | 6/2002 | Baerlocher et al. | 463/20 |
| 6,409,595 | B1 | 6/2002 | Uihlein et al. | 463/29 |
| 6,413,162 | B1 | 7/2002 | Baerlocher et al. | 463/20 |
| 6,425,824 | B1 | 7/2002 | Baerlocher et al. | 463/16 |
| 6,446,864 | B1 | 9/2002 | Kim et al. | 235/382 |
| 6,457,715 | B1 | 10/2002 | Friedman | 273/274 |
| 6,460,848 | B1 | 10/2002 | Soltys et al. | 273/149 R |
| 6,464,581 | B1 | 10/2002 | Yoseloff | 463/20 |
| 6,468,156 | B1 | 10/2002 | Hughs-Baird et al. | 463/25 |
| 6,471,208 | B2 | 10/2002 | Yoseloff et al. | 273/143 R |
| 6,485,366 | B1 | 11/2002 | Rowe | 463/13 |
| 6,502,116 | B1 | 12/2002 | Kelly et al. | 708/250 |
| 6,508,709 | B1 | 1/2003 | Karmarkar | 463/42 |
| 6,514,140 | B1 | 2/2003 | Storch | 463/25 |
| 6,517,435 | B2 | 2/2003 | Soltys et al. | 463/25 |
| 6,517,436 | B2 | 2/2003 | Soltys et al. | 463/29 |
| 6,517,437 | B1 | 2/2003 | Wells et al. | 463/30 |
| 6,520,857 | B2 | 2/2003 | Soltys et al. | 463/29 |
| 6,527,271 | B2 | 3/2003 | Soltys et al. | 273/148 R |
| 6,530,836 | B2 | 3/2003 | Soltys et al. | 463/29 |
| 6,530,837 | B2 | 3/2003 | Soltys et al. | 463/29 |
| 6,533,276 | B2 | 3/2003 | Soltys et al. | 273/148 R |
| 6,533,662 | B2 | 3/2003 | Soltys et al. | 463/25 |
| 6,533,664 | B1 | 3/2003 | Crumby | 463/42 |
| 6,543,770 | B1 | 4/2003 | Kaji et al. | 273/148 R |
| 6,561,897 | B1 | 5/2003 | Bourbour et al. | 463/13 |
| 6,568,678 | B2 | 5/2003 | Breeding et al. | 273/149 R |
| 6,579,180 | B2 | 6/2003 | Soltys et al. | 463/25 |
| 6,579,181 | B2 | 6/2003 | Soltys et al. | 463/25 |
| 6,581,747 | B1 | 6/2003 | Charlier et al. | 194/214 |
| 6,582,301 | B2 | 6/2003 | Hill | 463/11 |
| 6,588,750 | B1 | 7/2003 | Grauzer et al. | 273/149 R |
| 6,588,751 | B1 | 7/2003 | Grauzer et al. | 273/149 R |
| 6,595,857 | B2 | 7/2003 | Soltys et al. | 463/29 |
| 6,599,185 | B1 | 7/2003 | Kaminkow et al. | 463/16 |
| 6,629,889 | B2 | 10/2003 | Mothwurf | 463/25 |
| 6,638,161 | B2 | 10/2003 | Soltys et al. | 463/12 |
| 6,651,981 | B2 | 11/2003 | Grauzer et al. | 273/149 R |
| 6,651,982 | B2 | 11/2003 | Grauzer et al. | 273/149 R |
| 6,652,379 | B2 | 11/2003 | Soltys et al. | 463/22 |
| 6,655,684 | B2 | 12/2003 | Grauzer et al. | 273/149 R |
| 6,659,460 | B2 | 12/2003 | Blaha et al. | 273/149 R |
| 6,663,490 | B2 | 12/2003 | Soltys et al. | 463/25 |
| 6,676,127 | B2 | 1/2004 | Johnson et al. | 273/149 R |
| 6,676,516 | B2 | 1/2004 | Baerlocher et al. | 463/25 |
| 6,685,568 | B2 | 2/2004 | Soltys et al. | 463/47 |
| 6,688,979 | B2 | 2/2004 | Soltys et al. | 463/25 |
| 6,698,756 | B1 | 3/2004 | Baker et al. | 273/149 R |
| 6,698,759 | B2 | 3/2004 | Webb et al. | 273/292 |
| 6,712,693 | B1 | 3/2004 | Hettinger | 463/20 |
| 6,712,696 | B2 | 3/2004 | Soltys et al. | 463/25 |
| 6,719,288 | B2 | 4/2004 | Hessing et al. | 273/149 R |
| 6,726,205 | B1 | 4/2004 | Purton | 273/148 R |
| 6,728,740 | B2 | 4/2004 | Kelly et al. | 708/250 |
| 6,729,956 | B2 | 5/2004 | Wolf et al. | 463/25 |
| 6,729,961 | B1 | 5/2004 | Millerschone | 463/30 |
| 6,746,330 | B2 | 6/2004 | Cannon | 463/25 |
| 6,758,751 | B2 | 7/2004 | Soltys et al. | 463/29 |
| 6,857,961 | B2 | 2/2005 | Soltys et al. | 463/47 |
| 6,889,979 | B2 | 5/2005 | Blaha et al. | 273/149 R |
| 6,896,618 | B2 | 5/2005 | Benoy et al. | 463/25 |
| 6,923,719 | B2 | 8/2005 | Wolf | 463/16 |
| 6,955,599 | B2 | 10/2005 | Bourbour et al. | 463/13 |
| 6,964,612 | B2 | 11/2005 | Soltys et al. | 463/47 |
| 6,991,544 | B2 | 1/2006 | Soltys et al. | 463/42 |
| 7,011,309 | B2 | 3/2006 | Soltys et al. | 273/149 R |
| 7,029,009 | B2 | 4/2006 | Grauzer et al. | 273/149 P |
| 7,036,818 | B2 | 5/2006 | Grauzer et al. | 273/149 R |
| 7,073,791 | B2 | 7/2006 | Grauzer et al. | 273/149 R |
| 7,137,627 | B2 | 11/2006 | Grauzer et al. | 273/149 R |
| 7,255,344 | B2 | 8/2007 | Grauzer et al. | 273/149 R |
| 2002/0063389 | A1 | 5/2002 | Breeding et al. | 273/292 |
| 2002/0147042 | A1 | 10/2002 | Vuong et al. | 463/40 |
| 2002/0163125 | A1 | 11/2002 | Grauzer et al. | 273/149 R |
| 2002/0187821 | A1 | 12/2002 | Soltys et al. | 463/11 |
| 2003/0032474 | A1 | 2/2003 | Kaminkow | 463/25 |
| 2003/0036425 | A1 | 2/2003 | Kaminkow et al. | 463/25 |
| 2003/0064774 | A1 | 4/2003 | Fujimoto et al. | 463/16 |
| 2003/0083126 | A1 | 5/2003 | Paulsen | 463/25 |
| 2003/0176209 | A1 | 9/2003 | Soltys et al. | 463/13 |
| 2004/0005920 | A1 | 1/2004 | Soltys et al. | 463/25 |
| 2004/0067789 | A1 | 4/2004 | Grauzer et al. | 463/11 |
| 2004/0100026 | A1 | 5/2004 | Haggard | 273/304 |
| 2004/0108255 | A1 | 6/2004 | Johnson | 209/547 |
| 2004/0108654 | A1 | 6/2004 | Grauzer et al. | 273/148 R |
| 2004/0169332 | A1 | 9/2004 | Grauzer et al. | 273/149 R |
| 2004/0207156 | A1 | 10/2004 | Soltys et al. | 273/292 |
| 2004/0224777 | A1 | 11/2004 | Smith et al. | 463/47 |
| 2005/0012270 | A1 | 1/2005 | Schubert et al. | 273/149 R |
| 2005/0023752 | A1 | 2/2005 | Grauzer et al. | 273/149 R |
| 2005/0026680 | A1 | 2/2005 | Gururajan | 463/25 |
| 2005/0026681 | A1 | 2/2005 | Grauzer et al. | 463/29 |
| 2005/0026682 | A1 | 2/2005 | Grauzer et al. | 463/29 |
| 2005/0040594 | A1 | 2/2005 | Krenn et al. | 273/149 R |
| 2005/0051955 | A1 | 3/2005 | Schubert et al. | 273/149 R |
| 2005/0051965 | A1 | 3/2005 | Gururajan | 273/292 |
| 2005/0054408 | A1 | 3/2005 | Steil et al. | 463/11 |
| 2005/0059479 | A1 | 3/2005 | Soltys et al. | 463/29 |
| 2005/0062226 | A1 | 3/2005 | Schubert et al. | 273/149 R |
| 2005/0062227 | A1 | 3/2005 | Grauzer et al. | 273/149 R |
| 2005/0073102 | A1 | 4/2005 | Yoseloff et al. | 273/292 |
| 2005/0093230 | A1 | 5/2005 | Grauzer et al. | 273/149 R |
| 2005/0101367 | A1 | 5/2005 | Soltys et al. | 463/12 |
| 2005/0121852 | A1 | 6/2005 | Soltys et al. | 273/149 P |
| 2005/0137005 | A1 | 6/2005 | Soltys et al. | 463/13 |
| 2005/0156318 | A1 | 7/2005 | Douglas | 257/761 |
| 2005/0164761 | A1 | 7/2005 | Tain | 463/13 |
| 2005/0288083 | A1 | 12/2005 | Downs, III | 463/11 |
| 2005/0288084 | A1 | 12/2005 | Schubert | 463/11 |
| 2005/0288085 | A1 | 12/2005 | Schubert et al. | 463/11 |
| 2006/0001217 | A1 | 1/2006 | Soltys et al. | 273/292 |

FOREIGN PATENT DOCUMENTS

| | | | |
|---|---|---|---|
| DE | 197 48 930 | A1 | 5/1998 |
| EP | 0 327 069 | A2 | 8/1989 |
| EP | 0 790 848 | | 8/1997 |
| EP | 0 700 980 | B1 | 11/1999 |
| EP | 1 291 045 | A2 | 3/2003 |
| FR | 530732 | | 12/1921 |
| FR | 24238 | | 3/1922 |
| FR | 2 775 196 | | 8/1999 |
| GB | 2 246 520 | A | 2/1992 |
| GB | 2 370 791 | A | 7/2002 |
| GB | 2 380 143 | A | 4/2003 |
| WO | WO 96/36253 | | 11/1996 |
| WO | WO 99/43403 | | 9/1999 |
| WO | WO 02/05914 | A1 | 1/2002 |
| WO | WO 02/051512 | A2 | 7/2002 |
| WO | WO 03/004116 | A1 | 1/2003 |

WO WO 2006/039308 A2 4/2006

OTHER PUBLICATIONS

English Translation of German Patent No. DE 197 48 930, publication dated of May 14, 1998, inventor: Markeev.
U.S. Appl. No. 10/885,875, filed Jul. 7, 2004, Soltys et al.
U.S. Appl. No. 10/902,436, filed Jul. 29, 2004, Soltys et al.
U.S. Appl. No. 10/962,166, filed Oct. 8, 2004, Soltys et al.
U.S. Appl. No. 11/059,743, filed Feb. 16, 2005, Soltys et al.
U.S. Appl. No. 11/112,793, filed Apr. 21, 2005, Soltys et al.
U.S. Appl. No. 11/337,375, filed Jan. 23, 2006, Soltys et al.
U.S. Appl. No. 11/352,416, filed Feb. 10, 2006, Soltys.
U.S. Appl. No. 11/428,240, filed Jun. 30, 2006, Fleckenstein.
U.S. Appl. No. 11/428,244, filed Jun. 30, 2006, Soltys.
U.S. Appl. No. 11/428,249, filed Jun. 30, 2006, Fleckenstein.
U.S. Appl. No. 11/428,258, filed Jun. 30, 2006, Fleckenstein.
U.S. Appl. No. 11/428,264, filed Jun. 30, 2006, Soltys.
U.S. Appl. No. 11/428,286, filed Jun. 30, 2006, Soltys et al.
U.S. Appl. No. 11/437,590, filed May 19, 2006, Soltys et al.
U.S. Appl. No. 11/478,360, filed Jun. 29, 2006, Fleckenstein.
U.S. Appl. No. 11/479,930, filed Jun. 30, 2006, Soltys et al.
U.S. Appl. No. 11/479,963, filed Jun. 29, 2006, Fleckenstein.
U.S. Appl. No. 11/479,991, filed Jun. 29, 2006, Soltys.
U.S. Appl. No. 11/480,273, filed Jun. 30, 2006, Soltys.
U.S. Appl. No. 11/480,275, filed Jun. 30, 2006, Fleckenstein.
U.S. Appl. No. 11/480,295, filed Jun. 29, 2006, Fleckenstein.
U.S. Appl. No. 11/480,321, filed Jun. 30, 2006, Soltys.
U.S. Appl. No. 11/480,345, filed Jun. 30, 2006, Fleckenstein.
U.S. Appl. No. 11/480,349, filed Jun. 30, 2006, Soltys et al.
U.S. Appl. No. 11/519,244, filed Sep. 11, 2006, Soltys et al.
U.S. Appl. No. 60/838,280, filed Aug. 17, 2006, Soltys et al.
Bulavsky, J., "Tracking the Tables," *Casino Journal*, May 2004, pp. 44-47, accessed Dec. 21, 2005, URL =http://www.ascendgaming.com/cj/vendors_manufacturers_table/Trackin916200411141AM.htm, 5 pages.
Burke, A., "Tracking the Tables," reprinted from *International Gaming & Wagering Business*, Aug. 2003, 4 pages.
Griffin, P., *The Theory of Blackjack*, GBC Press, Las Vegas, Nevada, 1979, 190 pages.
Gros, R., "All You Ever Wanted to Know About Table Games," reprinted from *Global Gaming Business*, Aug. 1, 2003, 2 pages.
Pro, L.V., "Book Review—The Card Counter's Guide to Casino Surveillance," *Blackjack Insider Newsletter*, May 2003, #40, accessed Aug. 25, 2006, URL =http:/bjinsider.com/newsletter_40_surveillance.shtml, 5 pages.
Scarne, J., *Scarne's Encyclopedia of Games*, Harper & Row, New York, 1973, p. 153.
Scarne, J., *Scarne's New Complete Guide to Gambling*, Simon & Schuster, Inc., New York, 1974, pp. 358-359.
Snyder, A., "The High-Tech Eye," excerpt from *Blackjack Forum*, Spring 1997, accessed Dec. 21, 2005, from Casino Software & Services, LLC, URL =http://www.casinosoftware.com/bj_forum.html.
Terdiman, D., "Who's Holding the Aces Now?", reprinted from *Wired News*, Aug. 18, 2003, 2 pages.
Ward, K., "BJ Tracking System has Players Down for the Count," *Gaming Today*, Mar. 5, 2002, accessed Dec. 21, 2005, from Casino Software & Services, LLC, URL =http://www.casinosoftware.com/gaming_today.html.
Winkler, C., "Product Spotlight: MindPlay," reprinted from *Gaming and Leisure Technology*, Fall 2003, 2 pages.
Bally TMS, "MP21—Automated Table Tracking/Features," 2 pages, Nov. 2005.
Bally TMS, "MPBacc—Intelligent Table Tracking/Features," 2 pages, Nov. 2005.
Bally TMS, "MPBacc—Specifications/Specifications," 2 pages, Nov. 2005.
Bravo Gaming Systems, "Casino Table Wager Analysis and Player Tracking System—Table Operations/Unique Features," accessed Apr. 11, 2005, URL = http://www.genesisgaming.com, 4 pages.
Casino Software & Services, LLC., accessed Aug. 25, 2006, URL = http:/casinosoftware.com/home.html, 6 pages.
International Guild of Hospitality & Restaurant Managers, "Shuffle Master, Inc. (NasdaqNM:SHFL)," accessed Dec. 30, 2003, URL = http://hospitalityguide.com/Financial/Casinos/Shuffle.htm, 3 pages.
Mikohn, "Mikohn Tablelink—The Industry's Premier Table Tracking Solution Delivers Improvements Straight to the Bottom Line," 2 pages, before Jan. 1, 2004.
Mikohn, "Tablelink™, The New Standard in Table Games," before Jan. 1, 2004, 14 pages.
Plaintiff's Declaration of Lawrence Luciano in Opposition to Shuffle Master's Motion for Preliminary Injunction, *Card, LLC* v. *Shuffle Master, Inc.,* D. Nev. (No. CV-N-03-0244-ECR-(RAM)), Nov. 24, 2003.
Shuffle Master, Inc., "Shuffle Master Announces New Products; Intelligent Table System to Be Debuted at G2E," Sep. 10, 2003, 2 pages.

* cited by examiner

DEVICE FOR USE IN PLAYING CARD HANDLING SYSTEM

CROSS-REFERENCE TO RELATED APPLICATION

This application claims the benefit under 35 U.S.C. §119 (e) of U.S. Provisional Patent Application No. 60/793,267 filed Apr. 18, 2006.

BACKGROUND OF THE INVENTION

1. Field of the Invention

This description generally relates to the field of table gaming, and more particularly to playing card handling systems, for example playing card shufflers and/or sorters.

2. Description of the Related Art

Card handling systems typically receive discarded playing cards after being used in a card game and arrange the playing cards in a random sequence or a sorted order, for example the order of playing cards in a new deck prior to being shuffled. The card handling system may store the playing cards in a card receiver, such as a rack, stack, carousel or other array. The card receiver typically includes several compartments, each compartment sized to receive one or more playing cards. During operation, the card handling system must extract the playing cards from the compartments.

One approach employs ejectors to expel the playing cards from the compartments. The ejector sharply strikes an inside edge of the playing card, forcefully expelling the playing card from the compartment. The ejector applies substantial force to the edge of the playing card, which may mar or mark the playing cards or otherwise damage the playing cards. This reduces the useful life of a card deck, increasing costs. This may also leave recognizable mars or marks, facilitating card counters in gaining an advantage against the casino.

Another approach employs a card selector to frictionally engage a portion of the playing cards. The card selector typically includes a friction roller positioned at an end of a shaft, which is driven by an electric motor either directly or via a drive system. The friction roller frictionally withdraws the playing card from the compartment, and propels the playing card to a pair of speed up rollers. The approach may disadvantageously cause the playing card to scrape against a side of the compartment, which may cause mar or damage the playing card. The friction roller itself may cause significant wear to the playing cards. Further, the speed difference between the friction roller and the speed up roller causes an abrupt change in card speed which may further damage the playing card.

It is therefore desirable to have a device that addresses or alleviates at least some of the above stated problems.

BRIEF SUMMARY OF THE INVENTION

According to one aspect, a picker mechanism for use in a playing card handling device includes a body mounted for pivotal movement about a body rotational axis, a first jaw physically coupled to the body for pivotal movement therewith about the body rotational axis, the first jaw having a playing card engagement surface, a second jaw physically coupled to the body for movement therewith about the body rotational axis, the second jaw having a playing card engagement surface opposed to the playing card engagement surface of the first jaw, the second jaw being selectively moveable with respect to the first jaw between a closed position where at least the respective playing card engagement surfaces of the first and the second jaws are proximate one another, and an opened position where the playing card engagement surfaces of the first and the second jaws are spaced apart from one another relative to the closed position, a first actuator coupled to selectively pivotally drive the body about the body rotational axis, and a second actuator coupled to selectively move the second jaw relative to the first jaw between the opened and the closed positions.

According to one aspect, a playing card handling device includes a carousel of compartments mounted for pivotal movement about a carousel rotational axis, each of the compartments sized to receive a playing card, a first jaw having a playing card engagement surface a second jaw having a playing card engagement surface opposed to the playing card engagement surface of the first jaw, the second jaw being selectively moveable with respect to the first jaw between a closed position where at least the respective playing card engagement surfaces of the first and the second jaws are proximate one another, and an opened position where the playing card engagement surfaces of the first and the second jaws are spaced apart from one another relative to the closed position, and wherein the first and the second jaws are physically coupled for pivotal movement about a picker rotational axis that is parallel to the carousel rotational axis between a first position where the playing card engagement surfaces of the first and the second jaws engage at least a portion of a playing card while the playing card is not partially or fully withdrawn from one of the compartments of the carousel and a second position where the playing card is at least partially withdrawn from the compartment of the carousel, a first actuator coupled to selectively pivotally drive the body about the picker rotational axis, and a second actuator coupled to selectively move the second jaw relative to the first jaw between the opened and the closed positions.

According to another aspect, a method of handling playing cards in a playing card handling device includes pivoting a pair of jaws to a playing card engagement position proximate a playing card receiver, closing the pairs of jaws at the playing card engagement position to physically engage a portion of a playing card residing at least partially in a portion of the playing card receiver, rotating at least one pickup roller at a first rotational velocity, pivoting the pair of jaws to a playing card pickup position where the at least one pickup roller frictionally engages at least a portion of the playing card, and allowing the at least one pickup roller to extricate the playing card from the pair of jaws.

BRIEF DESCRIPTION OF THE SEVERAL VIEWS OF THE DRAWING(S)

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

Figure 1:
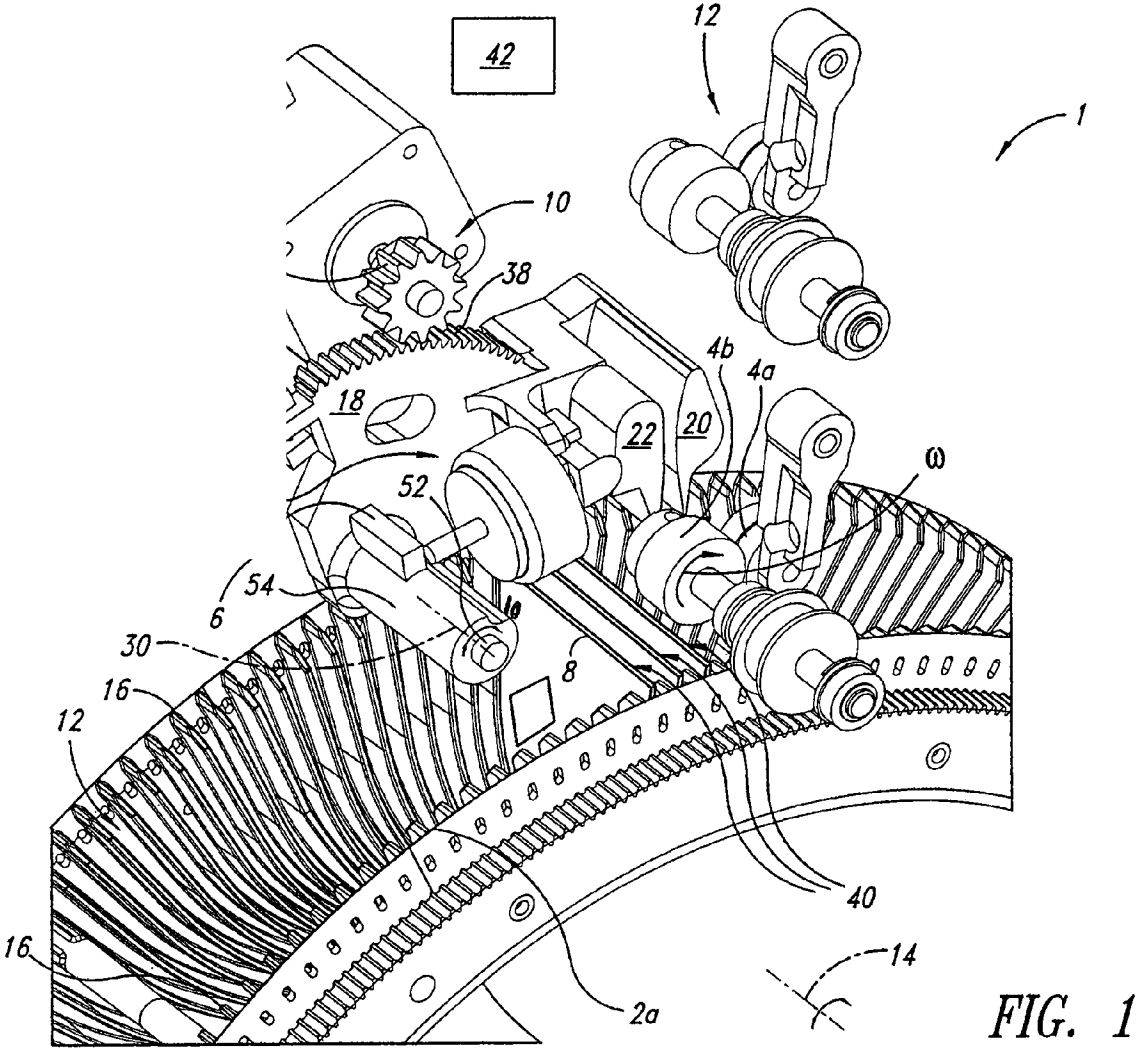
FIG. 1 is a partial isometric view of a playing card handling device including a card picker with a pair of jaws that are in an opened position prior to withdrawal of a playing card from a compartment, according to one illustrated embodiment.

In the following description, certain specific details are set forth in order to provide a thorough understanding of various embodiments of the invention. However, one skilled in the art will understand that the embodiments may be practiced without these details. In other instances, well-known structures associated with card handling devices, controllers, processors, transport mechanisms, and readers have not been shown or described in detail to avoid unnecessarily obscuring the description.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combinable in any suitable manner in one or more embodiments.

The headings provided herein are for convenience only and do not interpret the scope or meaning of the claimed invention.

This description generally relates to a card picking mechanism for use in a playing card handling device. The playing card handling device handles, sorts, randomizes, and/or shuffles a number of playing cards. The card picking mechanism functions to minimize degradation to the playing cards as the playing cards are withdrawn from a playing card receiver such as, for example a carousel. The term "carousel" is used herein to refer to a playing card receiver that rotates or pivots about an axis and should not be construed as limiting the scope of the claimed invention.

During a card game, at least some of the playing cards will be in-play, where the in-play cards are those currently in use by a gaming participant (i.e., player and/or dealer) to make a hand of playing cards according to a set of rules for the game played at the gaming table. For example, a number of initial blackjack hands may comprise the in-play cards. During and after the card game, the in-play cards are discarded by and/or collected from the participants and are referred to as collected cards, which are to be returned by a dealer or another to the playing card handling device.

The collected cards are successively moved into the card handling device at which point they are referred to as transitional cards. It is understood that many features of the card handling device are operated by controllable logic. The transitional cards are directed along various card paths and either placed in playing card receivers (e.g., which may take the form of carousels, arrays, racks, trays, or an equivalent device), at which point the cards are referred to as inventory cards. Additionally or alternatively, the transitional cards may be moved directly to an ordered group referred to herein as deliverable cards.

The deliverable cards are periodically transported to a location accessible by a participant at the gaming table, at which point the cards are referred to herein as dealable cards. In one embodiment, the deliverable cards are transported to the location accessible by the participant only after a predetermined number of deliverable cards have been grouped together. In many card games, the dealable cards are placed in a card shoe before the dealable cards are dealt to participants in the next or at least in an upcoming card game.

The deliverable cards are arranged (i.e., sequenced) according to a virtual sequence. In one embodiment, the virtual sequence is an ordering of electronic data, wherein the electronic data corresponds to playing card values (e.g., rank and suit) for a plurality of playing cards, which may comprise fewer or more cards than the number of playing cards in a standard, fifty-two (52) card deck. The virtual sequence may be computationally generated (e.g., via a random number generator (RNG)). Additionally or alternatively, the virtual sequence may be determined from predefined data such as one or more lookup tables, for example a sorted order that corresponds to the order of cards, un-shuffled, from a new playing deck. Once the virtual sequence is at least partially completed, the card handling system operates to build the deliverable cards according to at least a portion of the virtual sequence. By way of example, the deliverable cards can be selected from the transitional cards or come directly from the inventory cards. A card picker, described in detail below, may select the inventory cards from the playing card receiver. Hereinafter, "inventory cards" will be referred to as "playing cards."

FIG. 1 shows a partial isometric view of a playing card handling device 1 operable to arrange, shuffle, sort or otherwise handle playing cards 4 (only one shown) according to one illustrated embodiment.

The playing card handling device 1 comprises a playing card receiver 2, a first set of pickup rollers 4 (collectively referenced as 4, and individually referenced as 4*a*, 4*b*), and a card picker 6 operable to selectively withdraw playing cards 8 from the card receiver 2 and to smoothly deliver the withdrawn playing cards 8 to the pickup rollers 4. The playing card handling device 1 also comprises one or more electric motors 10 (only one shown), operable to drive various elements of the playing card handling device 1, such as the card receiver 2, card picker 6, pickup rollers 4, and/or other rollers.

As illustrated, the playing card receiver 4 may take the form of a carousel 2*a* having an endless plurality of compartments 12. The carousel 2*a* is mounted for pivotal movement about a carousel rotational axis 14. Each of the plurality of compartments 12 is sized to at least partially receive a standard sized playing card 8. Walls 16 forming the compartments 12 of the carousel 2*a* may be curved or arcuate to engage the generally straight and stiff playing cards 8, thereby retaining the playing cards 8 in the compartments 12 while the carousel 2*a* rotates about the carousel rotational axis 14. The card receiver 2 may take a form other than the carousel 2*a*, for example a rack or stack of compartments, although use of the carousel 2*a* with the described card picker 2 may be particularly advantageous at addressing some of the aforementioned problems, as discussed in more detail below.

A motor (not shown) advances the carousel 2*a* to align each successive compartment 12 with the card picker 6. The pivotal movement about the carousel rotational axis 14 may be bidirectional (e.g., clockwise and counterclockwise). This allows the motor to align a particular compartment 12 with the card picker 6 in the shortest possible time. The time to advance the carousel 2*a* may be approximately equal to or less than the amount of time it takes the card picker 6 to withdraw the playing card 8 from the compartment 12 and return to withdraw the next available playing card 8 from a subsequent compartment 12. The motor may, for example, take the form of a stepper motor.

Figure 3:
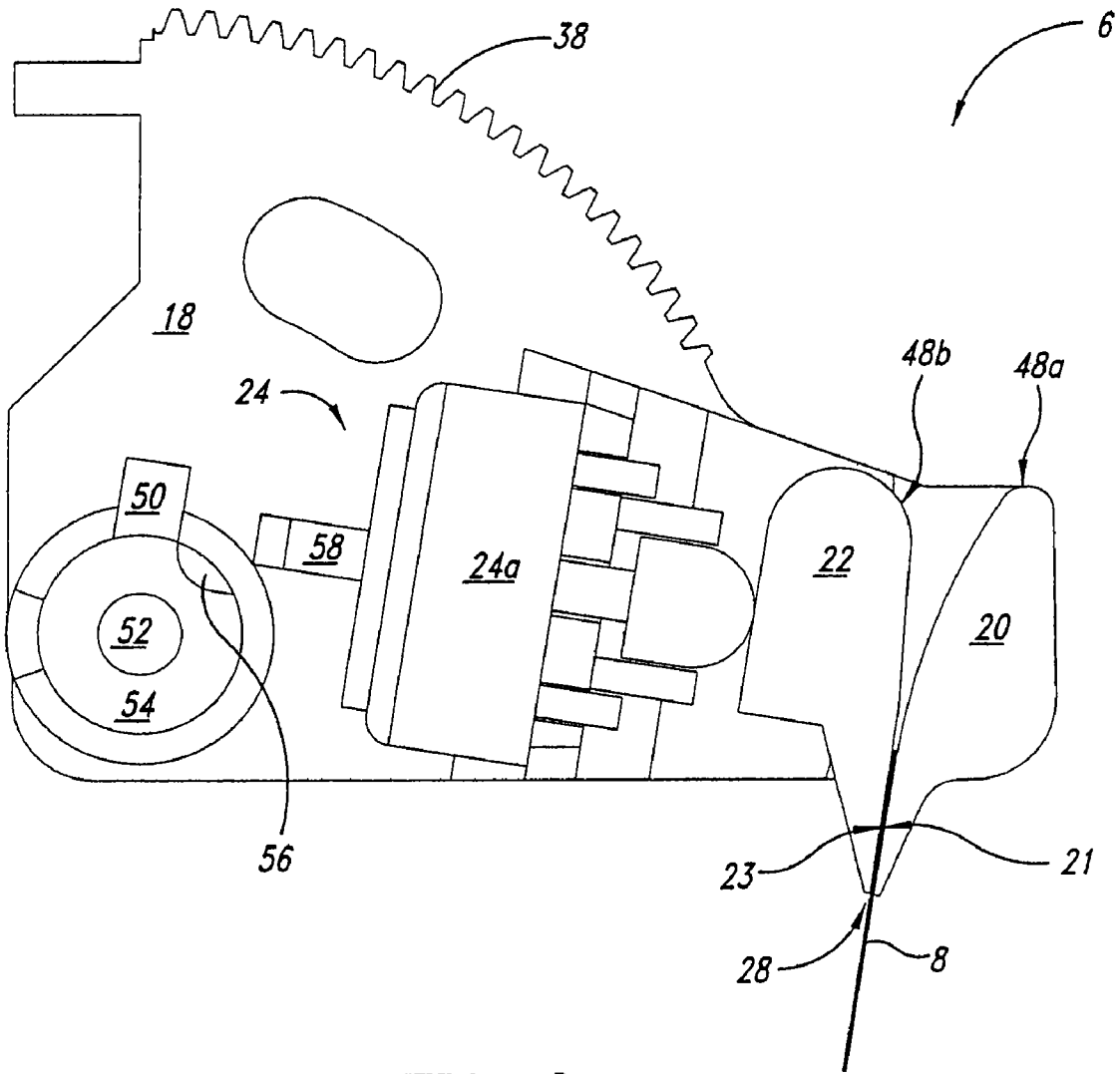
FIG. 3 is a side elevational view of the card picker of FIG. 1, with the pair of jaws in a closed position, holding the playing card after withdrawal of the playing card from the compartment.

The card picker 6 comprises a body 18, a first jaw 20 having a first playing card engagement surface 21, a second jaw 22 having a second playing card engagement surface 23 opposed the first playing card engagement surface 21, and an actuator 24 for moving at least one of the first and second jaws 20, 22 with respect to one another between an opened position 26 and a closed position 28 (FIG. 3). As illustrated, the actuator 24 may, for example, take the form of a solenoid 24*a*.

In the opened position 26, the card engagement surfaces 21, 23 of the first and second jaws 20, 22, respectively, are generally spaced apart from one another by a distance sufficient to accommodate the playing card 8 (e.g., greater than a thickness of the playing card). In the closed position, the card engagement surfaces 21, 23 of the jaws 20, 22 are generally proximate one another spaced by a distance sufficiently small as to grasp or engage the playing card 8 without marring or damaging the playing card 8 (e.g., approximately equal to or slightly less than a thickness of the playing card 8). As illustrated, the first jaw 20 is generally fixed with respect to the body 18, while the second jaw 22 pivots between the opened and closed positions 26, 28. Alternatively, the second jaw 22 may be generally fixed with respect to the body 18, while the first jaw 20 pivots between the opened and closed positions 26, 28. As a further alternative, both the first and the second jaws 20, 22, respectively, may pivot with respect to the body between the opened and closed positions 26, 28.

The card picker 6 is mounted for pivotal movement about a picker rotational axis 30 between at least a playing card withdrawal position 32 and at least a playing card placement position 34. The pivotal movement about the picker rotational axis 30 may be bidirectional (e.g., clockwise and counterclockwise). The jaws 20, 22 are physically coupled to pivot with the body 18 about the picker rotational axis 30. A rotational velocity of the first and second jaws 20, 22 rotating about the picker rotational axis 30 approximately matches a first rotational velocity ω of at least one of the pickup rollers 4. The actuator 24 may likewise be coupled to pivot with the body 18 about the picker rotational axis 30, although such is not necessary. In the playing card withdrawal position 32, the playing card engagement surfaces 21, 23 of the first and second jaws 20, 22, respectively, are positioned proximate to a compartment 12 of the card receiver 2 such that at least a portion of a playing card 8 at least partially received in the compartment 12 is received between the first and the second jaws 20, 22. In the playing card placement position 34, the playing card engagement surfaces 21, 23 of the first and second jaws 20, 22, respectively, are positioned proximate the first pair of pickup rollers 4 such that at least a portion of the playing card 8 is engaged by at least a portion of at least one of the first pair of pickup rollers 4. In the illustrated embodiment, the motor 10 drives a first set of teeth 36 that drivingly engage a second set of teeth 38 formed on, or coupled to, the body 18 of the picker 6 to move the picker 6 between the at least the playing card withdrawal and the playing card placement positions 32, 34. The motor 10 may be an electric motor such as a stepper motor.

The first set of pickup rollers 4 comprise a pair of opposed pickup rollers 4, where at least one of the pickup rollers 4*a*, 4*b* are rotatably driven at the first rotational velocity co. The first set of pickup rollers 4 are positioned to frictionally engage a leading edge 40 of the playing card 8, which is held between the playing card engagement surfaces 21, 23 of the first and second jaws 20, 22 in the closed position 28. The leading edge 40 of the playing card 8 engages the pickup rollers 4 while the first and second jaws 20, 22 are in rotation about the picker rotational axis 30 with a rotational velocity that approximately equals the first rotational velocity ω of the rollers 4. This may advantageously reduce the forces on the playing card 8, thereby reducing or eliminating, marring, wear, tearing or other damage.

The card handling device 1 may additionally comprise drive rollers 12 that are similar in structure to the first set of pickup rollers 4. The drive rollers 12 are positioned along a playing card transport path to urge the playing card 8 along the playing card transport path and to one or more destinations in the playing card handling device 1. The drive rollers 12 may or may not be arranged in pairs. One or both drive rollers 12 in a pair may be driven, or one or both drive rollers 12 in a pair may be freewheeling or alternatively fixed. Where driven, the drive roller 12 may or may not rotate at the first rotational velocity ω.

A controller 42 (FIG. 1) is communicatively coupled to control the motor 10. The controller 42 provides appropriate signals to cause the motor 10 to rotate the picker 6 in a desired direction. The controller 42 may further apply signals to the actuator 24 to control the mechanical motion of the first and second jaws 20, 22. The controller 42 may take the form of a microcontroller, microprocessor, application specific integrated circuit (ASIC), digital signal processor (DSP) and/or other digital or analog circuit, and may, or may not include memory.

Figure 2:
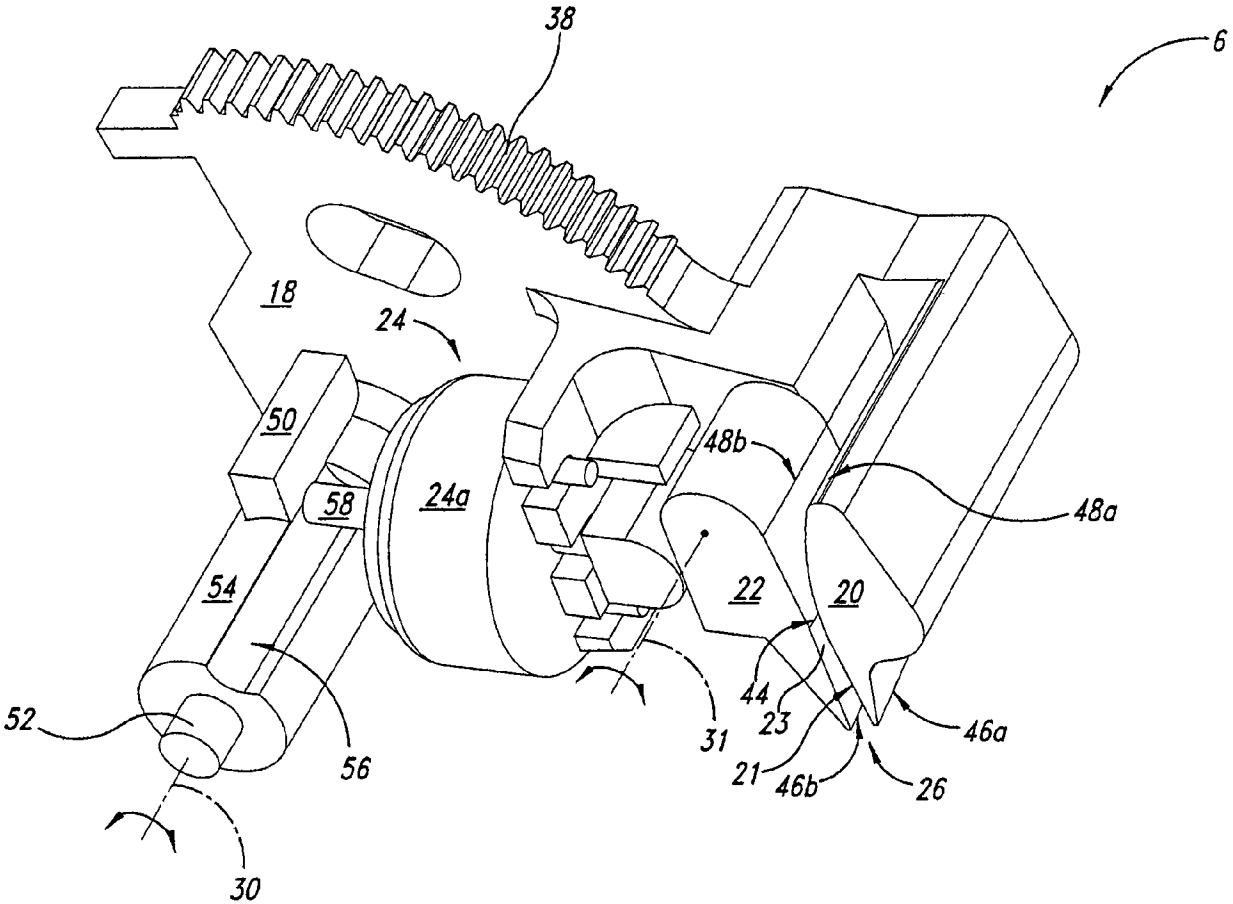
FIG. 2 is an isometric view of the card picker of FIG. 1.

FIG. 2 shows an isometric view of the card picker 6 in the opened position before engaging the playing card 8 between the first and second jaws 20, 22 while FIG. 3 shows a side view of the card picker 6 holding the playing card 8 between the first and second jaws 20, 22, according to one embodiment.

With reference to FIGS. 2-3, the first and second jaws 20, 22 are physically coupled to the body 18 of the card picker 6 for pivotal movement about the picker rotational axis 30 that is parallel to the carousel rotational axis 14. As illustrated, the first jaw 20 is generally fixed and the second jaw 22 pivots between the opened and closed positions 26, 28, respectively, about an axis 31. As noted above, in alternative embodiments the second jaw 22 may be fixed while the first jaw 20 pivots, or alternatively both the first and the second jaws 20, 22 may pivot.

In some embodiments, at least one of the opposed surfaces of the first and second jaws 20, 22 are peaked at an intermediate portion 44 between an inner edge (collectively referenced as 46 and individually referenced as 46*a*, 46*b*) and an outer edge (collectively referenced as 48 and individually referenced as 48*a*, 48*b*). The playing card engagement surfaces 21, 23 may be between the intermediate portion 44 and the inner edge 46, and in some embodiments may be proximate or adjacent the inner edge 46. As illustrated, the peaked surface of the first or second jaw 20, 22 may be an arcuate or curved surface, or alternatively may come to a sharp peak.

A portion of the playing card transport path is formed between the inner and outer edges 46, 48 of the first and second jaws 20, 22. The playing card 8 is received between the playing card engagement surfaces 21, 23 of the first and second jaws 20, 22 and exits between the outer edges 48 of the first and second jaws 20, 22. In the closed position 28, the playing card engagement surface 21 of the first jaw 20 is spaced from the playing card engagement surface 23 of the second jaw 22 by a distance approximately equal to or slightly less than a thickness of the playing card 8, while the outer edge 48*a* of the first jaw 20 is spaced from the outer edge 48*b* of the second jaw 22 by a distance greater than the thickness of the playing card 8. The peaked or arcuate surface(s), may advantageously align with, or otherwise provide a smooth transition with the pickup rollers 4. Such a smooth transition may, for example, be described as a playing card transport path that defines a smooth curve, without sharp angles, or without discontinuities in a first derivative of a mathematical function defining the card transport path.

As illustrated, the actuator 24 mechanically engages the second jaw 22 to selectively move the playing card engagement surface 23 into the closed position 28 so as to grasp or otherwise engage at least a portion of the playing card 8. The second jaw 22 may be biased to the opened position 26, or the actuator 24 may be operable to move the second jaw 22 to the opened position 26. Alternatively, the second jaw 22 may be biased to the closed position 28, and the actuator 24 may be operable to move the second jaw 22 to the opened position 26. The biasing may be accomplished using a spring coupled to one or both of the jaws 20, 22, and/or the actuator 24.

Where the card picker 6 employs a solenoid 24*a* for the actuator 24, a backstop 50 may be physically coupled to the body 18 to rotate there with about the picker rotational axis 30. The backstop 50 is positioned on an axis of the mechanical motion of the solenoid 24*a* to limit the travel of the solenoid 24*a*.

The body 18 is coupled to the card handling device 1 via an axel 52 that is coaxial with the picker rotational axis 30. The body 18 may further comprise a collar 54 protruding from one side of the body 18 and physically coupled thereto. The collar 54 securely receives at least a portion of the axel 52 extending between the side of the body 18 and the card handling device 1. The collar 54 and the card picker 6 rotate about the axel 52. As described above, the backstop 50 may be physically connected to the side of the body 18. Additionally or alternatively, the backstop 50 may be physically coupled to the collar 54.

Depending on an angle of inclination of the solenoid 24*a*, a groove 56 may be formed along a portion of the collar 54 proximate the backstop 50. The groove 56 allows a core 58 of the solenoid 24*a* to retract until contact is made with the backstop 50, thereby preventing the core 58 from being stopped prematurely by the collar 54. In some embodiments, the groove 56 may not be necessary because the structural dimensions of the picker 6 and related components, such as for example the angle of inclination of the solenoid 24*a*, may be different than illustrated.

Figure 4:
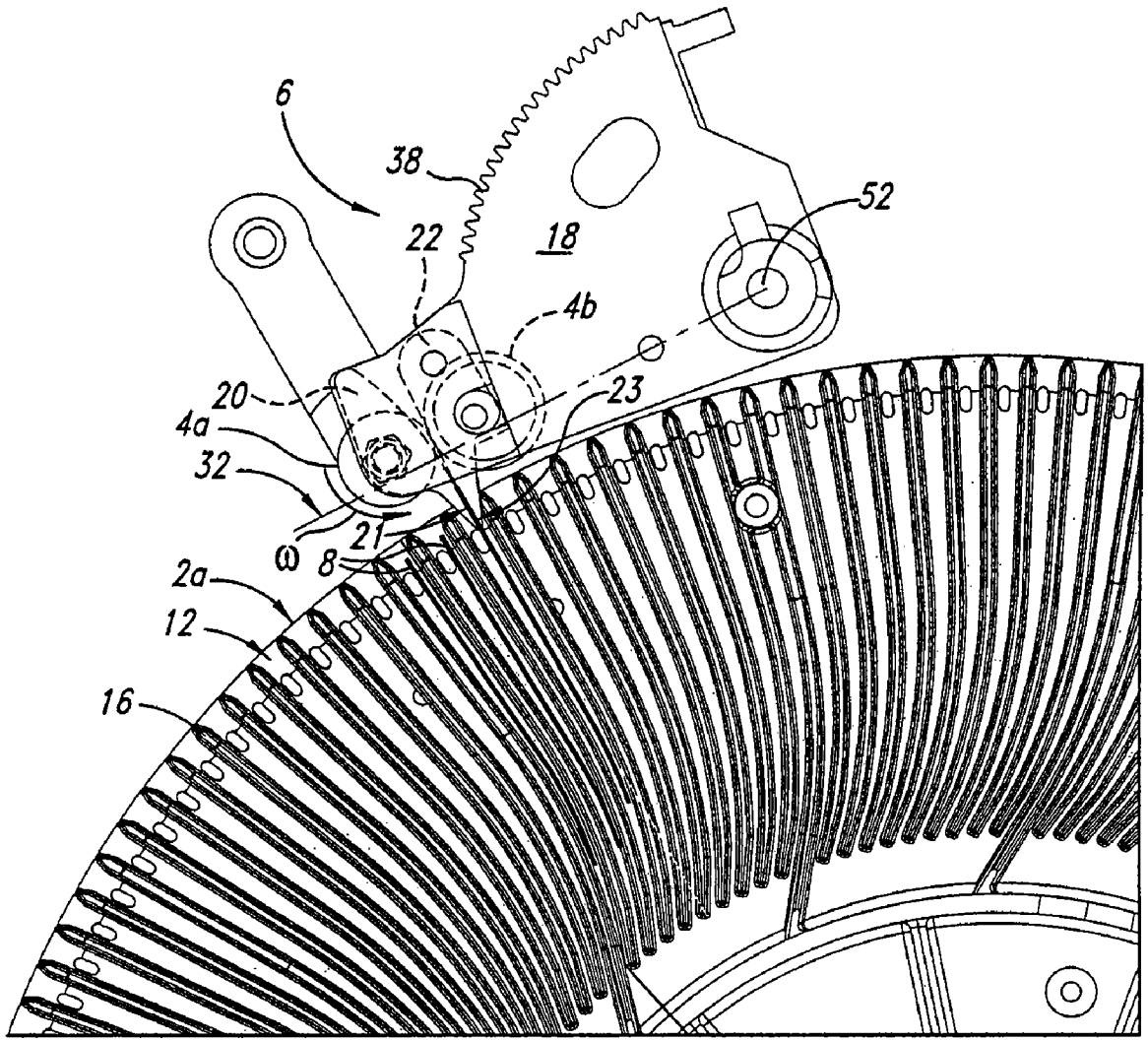
FIGS. 4-6 are sequential schematic illustrations of a transparent backside view of the card picker and carousel during operation, according to one embodiment.
Figure 5:
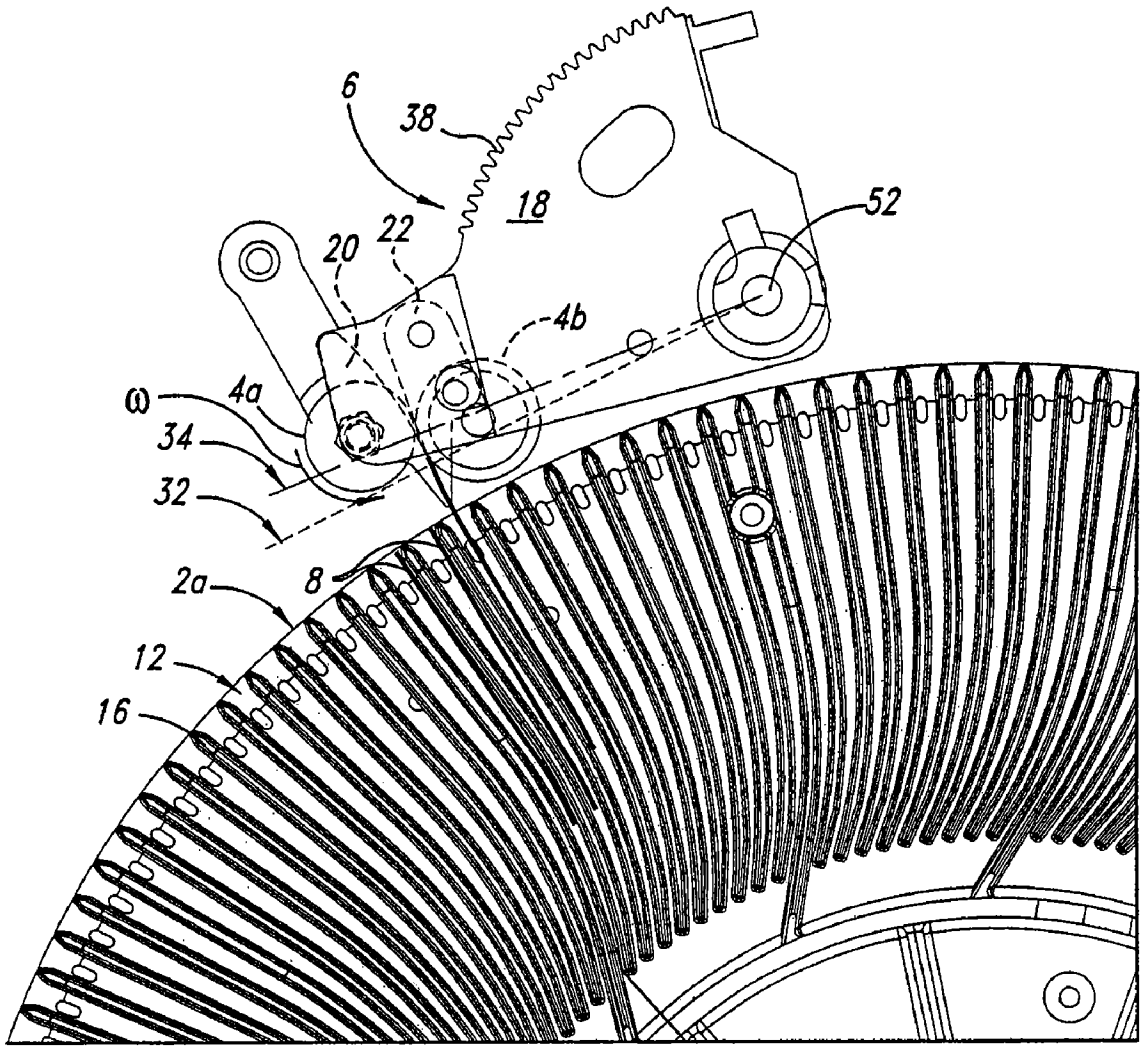
Figure 6:
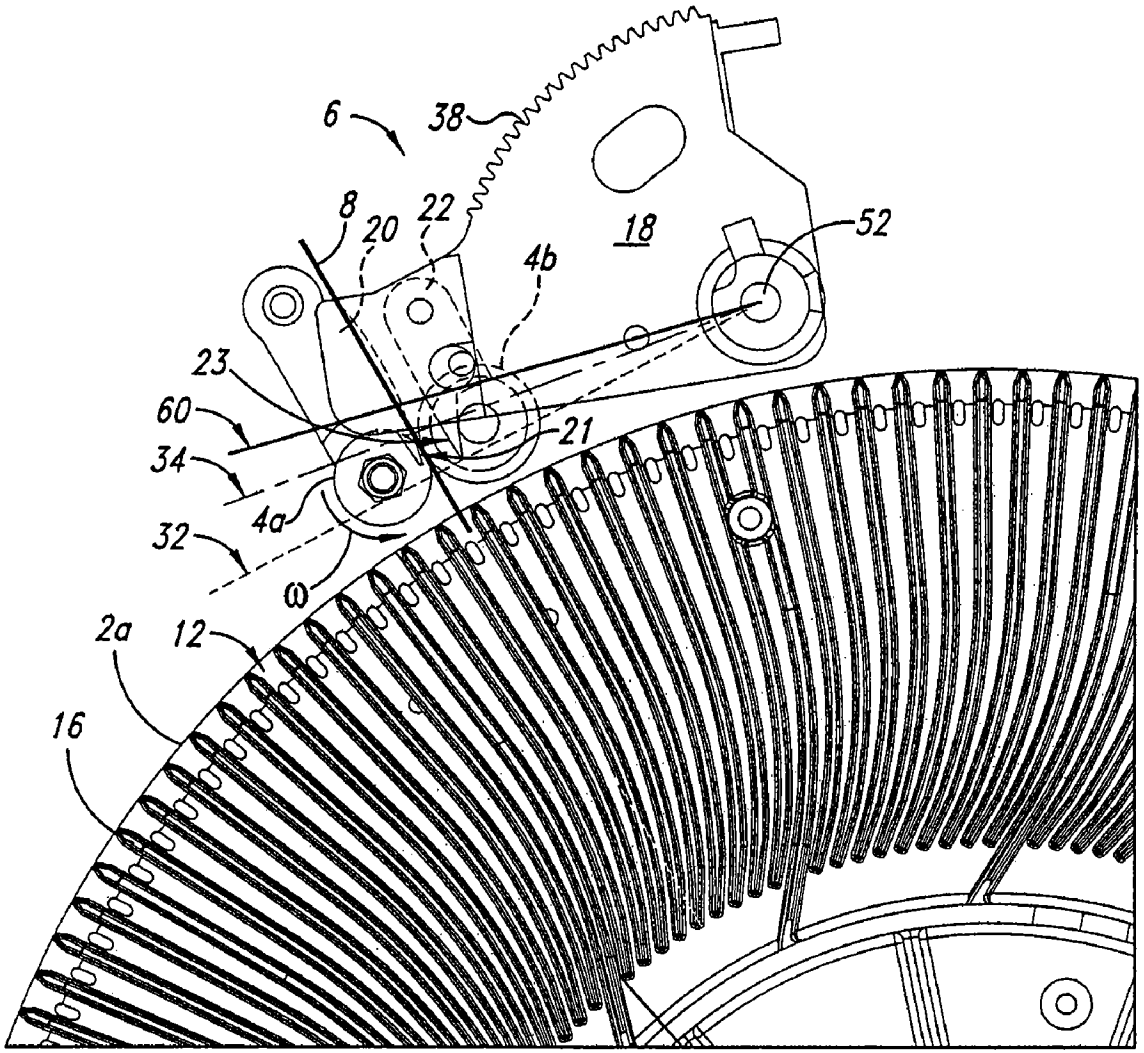

FIGS. 4-6 show sequential schematic illustrations of the card picker 6 and carousel 2*a* during operation, according to one embodiment. The illustrations depicted in FIGS. 4-6 show a transparent backside view of the card picker 6.

In particular, FIG. 4 illustrates the card picker 6 in the playing card withdrawal position 32. The controller 42 provides appropriate signals to cause the motor 10 to rotate the picker 6 with the jaws 20, 22 about the picker rotational axis 30 in the direction of the carousel 2*a*. The picker 6 may rotate with the jaws 20, 22 toward the carousel 2*a* while in the opened or closed position 26, 28. If the first and second jaws 20, 22 are in the closed position 28 prior to reaching the compartment 12, the actuator 24 may move the second jaw 22 into the opened position 26 so as to allow at least a portion of the playing card 8 to be received between the playing card engagement surfaces 21, 23. Once the playing card 8 is positioned between the playing card engagement surfaces 21, 23, the controller 42 signals the actuator 24 to mechanically engage the second jaw 22 to selectively move the playing card engagement surface 23 into the closed position 28 so as to grasp or otherwise engage at least the portion of the playing card 8. The portion of the selected playing card 8 may be held between the playing card engagement surfaces 21, 23 of the first and second jaws 20, 22.

As shown FIG. 5, the card picker 6 pivots from the playing card withdrawal position 32 to the playing card placement position 34. The controller 42 signals the motor 10 to rotate the picker 6 with the playing card 8 held between the jaws 20, 22 in a reverse rotational direction that is opposite the direction of the carousel 2*a*. The card picker 6 reaches the playing card placement position 34 at a speed approximately equal to the rotational speed co of at least one of the pickup rollers 4. The pickup rollers 4 frictionally engage the leading edge 40 of the playing card 8 as the playing card 8 is held between the jaws 20, 22. The frictional engagement with the pickup rollers 4 occurs after an angular rotation from the playing card withdrawal position 32 to the playing card placement position 34. At the playing card placement position 34, the controller 42 may signal the actuator 24 to move the second jaw 22 to the opened position 26 so as to release the playing card 8 from the grip of the jaws 20, 22. Alternatively, the card picker 6 with the playing card 8 held between the engagement surfaces 21, 23 of the jaws 20, 22 may continue rotation partially about the picker rotational axis 30 while the held playing card 8 simultaneously traverses through the rollers 4. This may advantageously ensure that the playing card 8 is engaged by the pickup rollers 4 prior to being released from the jaws 20, 22.

FIG. 6 illustrates the release of the playing card 8 from the pair of jaws 20, 22 after the pickup rollers 4 frictionally engage the leading edge 40 of the playing card 8. Such a position during the picker 6 rotation about the picker rotational axis 30 is referred to as a playing card releasing position 60. After the leading edge 40 of the playing card 8 sufficiently traverses the pickup rollers 4, the controller 42 signals the actuator 24 to release the portion of the playing card 8 held between the playing card engagement surfaces 21, 23 of the jaws 20, 22. The release of the playing card 8 allows the pickup roller 4 to trigger the traversal of the playing card 8 along the playing card transport path that may, or may not, include the additional drive rollers 12 rotating at approximately the rotational velocity co of the initial pickup rollers 4. The playing card transport path may lead the playing card 8 to one or more destinations in the playing card handling device 1.

Allowing the card picker 6 to overshoot the playing card placement position 34 and/or the playing card releasing position 60 may advantageously allow the angular or rotational velocity co of the card picker 6 to be maximum at the playing card placement position 34 and/or the playing card releasing position 60. The rotational velocity may be reduced after the card picker 6 passes the playing card placement position 34 and/or the playing card releasing position 60, in preparation for the return oscillation.

Figure 7:
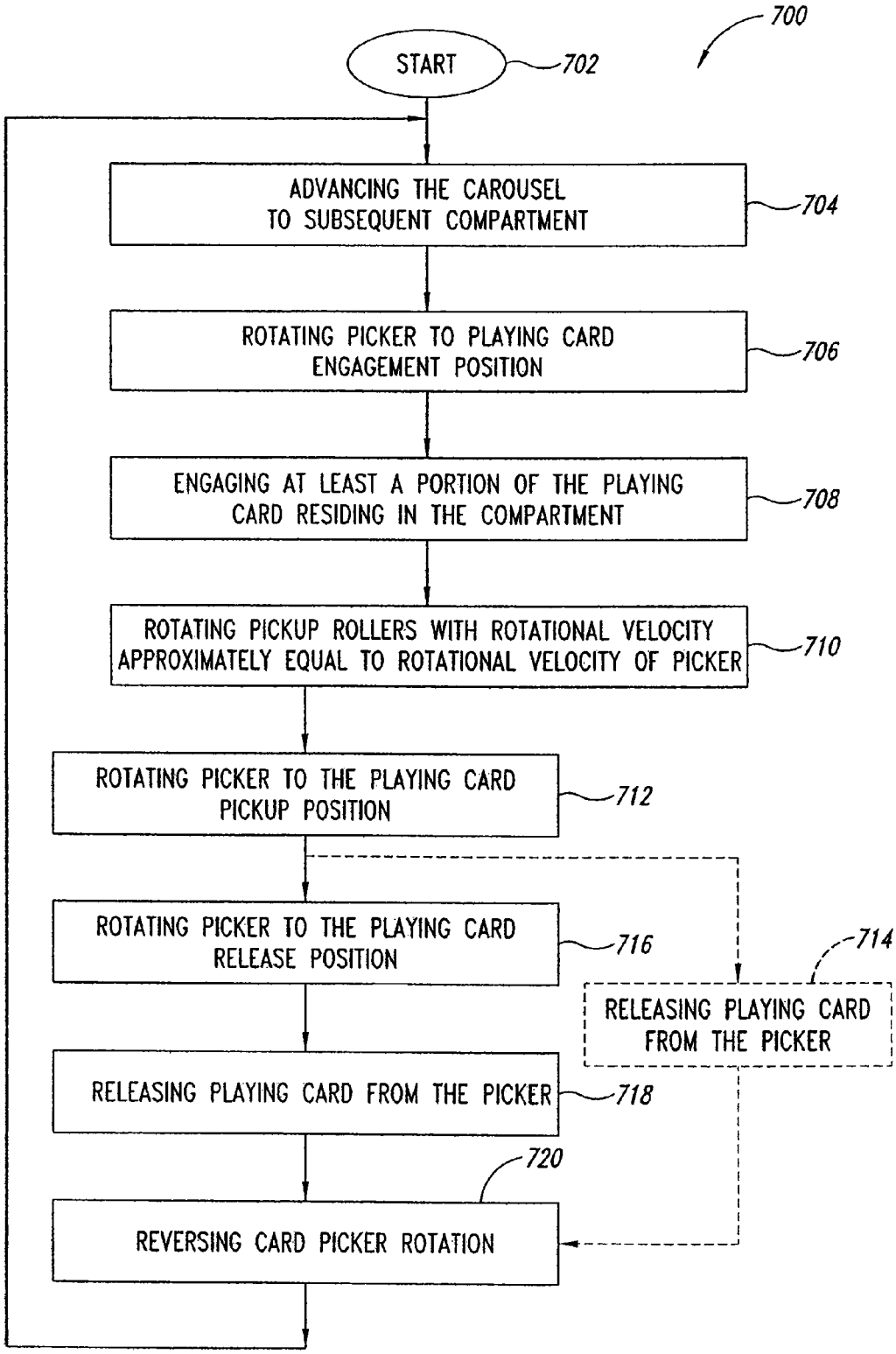
FIG. 7 is a flow diagram of a method of operating the card picker to withdraw a playing card from a compartment and provide the playing cards to a pair of pickup rollers, according to one illustrated embodiment.

FIG. 7 shows a flow diagram of a method 700 of operating the card picker 6 to withdraw the playing card 8 from the compartment 12 of the carousel 2*a* and to provide the playing card 8 to the pickup rollers 4, according to one illustrated embodiment.

The method 700 starts at 702, for example in response to an activation of the carousel 2*a* by the controller 42. As discussed above, at 704 the carousel 2*a* advances the playing card compartments 12 at a rate that is synchronous with the rotation of the card picker 6. The motor 10 advances the carousel 2*a* so that the jaws 20, 22 of the card picker 6 are aligned with the compartment 12 in which at least the portion of the playing card 8 resides.

At 706, the card picker 6 rotates about the picker rotational axis 30 to the playing card withdrawal position 32 proximate the carousel 2*a*. The playing card withdrawal position 32 is reached with the pair of jaws 20, 22 in the opened position 26 and at least the edge 40 of the playing card 8 aligned between the playing card engagement surfaces 21, 23 of the first and second jaws 20, 22. As described above, the picker 6 may rotate with the jaws 20, 22 toward the compartment 12 while in the closed position 28, in which case the controller 42 signals the actuator 24 to move the second jaw 22 into the opened position 26, prior to reaching the playing card withdrawal position 32.

At 708, the controller 42 signals the actuator 24 to mechanically engage the second jaw 22 to selectively move the playing card engagement surface 23 into the closed position 28 so as to grasp or otherwise engage at least the portion of the playing card 8 that resides at least partially within the portion of the playing card compartment 12. The first and second jaws 20, 22 are in the closed position 28 at the playing card withdrawal position 32.

At 710, at least one of the pickup rollers 4 begins rotating at the first rotational velocity co which is approximately equal to the rotational velocity about the picker rotational axis 30 of the first and second jaws 20, 22 proximate the playing card placement position 34. Alternatively, the at least one pickup roller 4 may be in constant rotation.

At 712, the card picker 6 with the jaws 20, 22 rotates about the picker rotational axis 30 through the playing card placement position 34 where at least one pickup roller 4 frictionally engages the leading edge 40 of the playing card 8.

Optionally, at 714, the controller 42 signals the actuator 24 to move the second jaw 22 to the opened position 26 so as to release the playing card 8 from the grip of the jaws 20, 22 and into the grasp of the pickup rollers 4. The method passes control to 720.

At 716, the card picker 6 continues rotating about the picker rotational axis 30, passing the playing card placement position 34 while the portion of the playing card 8 is held between the first and second jaws 20, 22, until the card picker 6 reaches the playing card releasing position 60. At the playing card releasing position 60, the leading edge 40 of the playing card 8 sufficiently traversed the pickup rollers 4 to ensure that a substantial portion of the playing card 8 is engaged by the pickup rollers 4.

At 718, the controller 42 signals the actuator 24 to release the portion of the playing card 8 held between the playing card engagement surfaces 21, 23 of the jaws 20, 22 and the at least one pickup roller 4 triggers the traversal of the playing card 8 along the playing card path as described in detail above.

At 720, the controller 42 signals the motor 10 to reverse the direction of the card picker 6 rotation about the picker rotational axis 30 in the direction of the carousel 2*a*. The method passes control to 702.

All of the above U.S. patents, U.S. patent application publications, U.S. patent applications, foreign patents, foreign patent applications and non-patent publications referred to in this specification and/or listed in the Application Data Sheet, including but not limited to U.S. Provisional Application No. 60/793,267, filed Apr. 18, 2006, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A picker mechanism for use in a playing card handling device, the picker comprising:

a body mounted for pivotal movement about a body rotational axis;

a first jaw physically coupled to the body for pivotal movement therewith about the body rotational axis, the first jaw having a playing card engagement surface;

a second jaw physically coupled to the body for movement therewith about the body rotational axis, the second jaw having a playing card engagement surface opposed to the playing card engagement surface of the first jaw, the second jaw being selectively moveable with respect to the first jaw between a closed position where at least the respective playing card engagement surfaces of the first and the second jaws are proximate one another, and an opened position where the playing card engagement surfaces of the first and the second jaws are spaced apart from one another relative to the closed position;

a first actuator coupled to selectively pivotally drive the body about the body rotational axis; and a second actuator coupled to selectively move the second jaw relative to the first jaw between the opened and the closed positions.

2. The picker of claim 1 wherein a playing card movement path is formed between an inner and an outer edge of the first and the second jaws, whereby a playing card received at the inner edges of the first and the second jaws exits via the outer edges of the first and the second jaws.

3. The picker of claim 1 wherein in the closed position an inner edge portion of the first jaw is spaced from an inner edge portion of the second jaw by a first distance, and wherein an outer edge portion of the first jaw is spaced from an outer edge portion of the second jaw by a second distance greater than the first distance.

4. The picker of claim 3 wherein the first distance is approximately equal to a thickness of a playing card, and the second distance is greater than the thickness of the playing card.

5. The picker of claim 3 wherein at least one of the first or the second jaws includes a peaked surface opposed to the other one of the first or the second jaws, wherein the inner and the outer edge portions slope toward a peak.

6. The picker of claim 5 wherein the peaked surface of at least one of the first and the second jaws includes an arcuate surface.

7. The picker of claim 1 wherein the first and the second jaws each comprise respective opposed arcuate surfaces, the respective card engagement surfaces of the first and the second jaws being a point on arcuate surfaces at which the distance between the first and the second jaws is minimum in the closed position.

8. The picker of claim 1, further comprising:

a pair of opposed pickup rollers, at least one of the pickup rollers rotatably driven at a first rotational velocity, the pickup rollers positioned to frictionally engage a leading edge of a playing card held between the first and the second jaws in the closed position, at a withdrawn position of the body.

9. The picker of claim 8 wherein a rotational velocity of the jaws about the body axis of rotation approximately matches a rotational velocity of at least one of the pickup rollers.

10. The picker of claim 1 wherein the body further comprises a first set of teeth, and wherein the first actuator comprises a second set of teeth enmeshing with the first set of teeth.

11. The picker of claim 1 wherein the first actuator comprises an electric motor and the second actuator comprises a solenoid.

12. A playing card handling device, comprising:

a carousel of compartments mounted for pivotal movement about a carousel rotational axis, each of the compartments sized to receive a playing card;

a first jaw having a playing card engagement surface;

a second jaw having a playing card engagement surface opposed to the playing card engagement surface of the first jaw, the second jaw being selectively moveable with respect to the first jaw between a closed position where at least the respective playing card engagement surfaces of the first and the second jaws are proximate one another, and an opened position where the playing card engagement surfaces of the first and the second jaws are spaced apart from one another relative to the closed position, and wherein the first and the second jaws are physically coupled for pivotal movement about a picker rotational axis that is parallel to the carousel rotational axis between a first position where the playing card engagement surfaces of the first and the second jaws engage at least a portion of a playing card while the playing card is not partially or fully withdrawn from one of the compartments of the carousel and a second position where the playing card is at least partially withdrawn from the compartment of the carousel;

a first actuator coupled to selectively pivotally drive the body about the picker rotational axis; and a second actuator coupled to selectively move the second jaw relative to the first jaw between the opened and the closed positions.

13. The playing card handling device of claim 12 wherein a playing card movement path is formed between an inner and an outer edge of the first and the second jaws, whereby a playing card received at the inner edges of the first and the second jaws exits via the outer edges of the first and the second jaws.

14. The playing card handling device of claim 12 wherein the first and the second jaws each comprise respective opposed arcuate surfaces, the respective card engagement surfaces of the first and the second jaws being a point on arcuate surfaces at which the distance between the first and the second jaws is minimum in the closed position.

15. The playing card handling device of claim 12, further comprising:

a pair of opposed pickup rollers, at least one of the pickup rollers rotatably driven at a first rotational velocity, the pickup rollers positioned to frictionally engage a leading edge of a playing card held between the first and the second jaws in the closed position, at or proximate the second position of the first and the second jaws.

16. The playing card handling device of claim 15 wherein a rotational velocity of the jaws about the body axis of rotation approximately matches a rotational velocity of at least one of the pickup rollers as the first and the second jaws approach the second position.

17. The playing card handling device of claim 12, further comprising:

a first set of teeth physically coupled to the first and the second jaws, wherein the first actuator comprises a second set of teeth enmeshing with the first set of teeth.

18. The playing card handling device of claim 17 wherein the first actuator comprises an electric motor and the second actuator comprises a solenoid.

19. A method of handling playing cards in a playing card handling device, the method comprising:

pivoting a pair of jaws to a playing card engagement position proximate a playing card receiver;

closing the pairs of jaws at the playing card engagement position to physically engage a portion of a playing card residing at least partially in a portion of the playing card receiver;

rotating at least one pickup roller at a first rotational velocity;

pivoting the pair of jaws to a playing card pickup position where the at least one pickup roller frictionally engages at least a portion of the playing card; and allowing the at least one pickup roller to extricate the playing card from the pair of jaws.

20. The method of claim 19, further comprising:

opening the pair of jaws at approximately a same time that the at least one pickup roller frictionally engages at least a portion of the playing card.

21. The method of claim 19, further comprising:

opening the pair of jaws after the at least one pickup roller frictionally engages the playing card.

22. The method of claim 19 wherein pivoting a pair of jaws to a playing card engagement position comprises applying a control signal that causes a rotor of an electric motor to rotate in a first direction and wherein pivoting the pair of jaws to a playing card pickup position comprises applying a control signal that causes the rotor of the electric motor to rotate in a second direction, opposite the first direction.

23. The method of claim 19 wherein pivoting the pair of jaws to a playing card pickup position comprises pivoting the jaws about a picker axis that is at least approximately parallel with a pickup roller axis about which the at least one pickup roller rotates.

24. The method of claim 23 wherein the pair of jaws have a rotational velocity proximate the playing card pickup position that is at least approximately equal to a rotational velocity of the at least one pickup roller.

25. The method of claim 19 wherein closing the pairs of jaws comprises applying a control signal to a solenoid that is mechanically coupled to at least one of the jaws.

26. The method of claim 19 wherein the card receiver is a carousel having a plurality of compartments each sized to receive a respective playing card, and further comprising:

pivoting the carousel around a carousel axis to align one of the compartment with the card engagement position of the pair of jaws.

* * * * *